US009704628B2

(12) United States Patent
Pant et al.

(10) Patent No.: US 9,704,628 B2
(45) Date of Patent: Jul. 11, 2017

(54) FERROFLUID-MWCNT HYBRID NANOCOMPOSITE IN LIQUID STATE

(71) Applicant: COUNCIL OF SCIENTIFIC AND INDUSTRIAL RESEARCH, New Delhi (IN)

(72) Inventors: Rajendra Prasad Pant, New Delhi (IN); Ajay Shankar, New Delhi (IN); Komal Jain, New Delhi (IN); Sonia, New Delhi (IN); Mahesh Chand, New Delhi (IN)

(73) Assignee: COUNCIL OF SCIENTIFIC AND INDUSTRIAL RESEARCH, New Delhi (IN)

( * ) Notice: Subject to any disclaimer, the term of this patent is extended or adjusted under 35 U.S.C. 154(b) by 182 days.

(21) Appl. No.: 14/747,172

(22) Filed: Jun. 23, 2015

(65) Prior Publication Data

US 2015/0371776 A1 Dec. 24, 2015

(30) Foreign Application Priority Data

Jun. 23, 2014 (IN) ..... 1673/DEL/2014

(51) Int. Cl.
*H01F 41/30* (2006.01)
*H01F 1/44* (2006.01)

(52) U.S. Cl.
CPC ..... *H01F 1/445* (2013.01)

(58) Field of Classification Search
CPC ..... H01F 1/44; H01F 1/445
See application file for complete search history.

(56) References Cited

U.S. PATENT DOCUMENTS

| | | | | |
|---|---|---|---|---|
| 6,975,063 | B2 | 12/2005 | Mao et al. | |
| 8,038,926 | B2 | 10/2011 | Gogotsi et al. | |
| 8,119,021 | B2 | 2/2012 | Gogotsi et al. | |
| 8,325,079 | B2 | 12/2012 | Shah et al. | |
| 9,129,732 | B2 * | 9/2015 | Rwei | H01F 1/445 |
| 2013/0112911 | A1 * | 5/2013 | Mazyar | H01F 1/01 252/62.54 |

OTHER PUBLICATIONS

Stamatin et al., "The synthesis of multi-walled carbon nanotubes (MWNTs) by catalytic pyrolysis of the phenol-formaldehyde resins", Physica E, vol. 37, pp. 44-48, 2007.

(Continued)

*Primary Examiner* — Carol M Koslow
(74) *Attorney, Agent, or Firm* — Hamre, Schumann, Mueller & Larson, P.C.

(57) ABSTRACT

A water based double surfacted ferrofluid having magnetite nanoparticles (2-18 nm) coated with primary and secondary surfactants is synthesized. On the other hand, an aqueous dispersion of functionalized MWCNT (diameter=14-18 μm, length=1.6-2.5 μm) is prepared by acid treatment. A hybrid solutions in different v/v ratios yielded stable dispersions having both nanoparticles and nanotubes in itself behave as one system. The synthesized hybrid fluid show magnetic response and self-sustained homogeneity of in presence of magnetic field. In addition, the hybrid fluids exhibits a long term sedimentation and magnetic stability which enables one to use them for various applications like MRI, EMI shielding, energy conversion etc.

6 Claims, 7 Drawing Sheets

(56) References Cited

OTHER PUBLICATIONS

Buang et al., "Characteristic of Mild Acid Functionalized Multiwalled Carbon Nanotubes Towards High Dispersion With Low Structural Defects", Digest Journal of Nanomaterials and Biostructures, vol. 7, No. 1, pp. 33-39, Jan.-Mar. 2012.
Manohara et al., "High-current-density field emitters based on arrays of carbon nanotube bundles", Journal of Vacuum Science & Technology B, vol. 23, No. 1, pp. 157-161, Jan./Feb. 2005.
Hiura, "Opening and Purification of Carbon Nanotubes in High Yields", Advanced Materials, vol. 7, No. 3, pp. 275-276, 1995.
Rosca et al., "Oxidation of multiwalled carbon nanotubes by nitric acid", Carbon, vol. 43, pp. 3124-3131, 2005.
Su et al., "Multi-wall carbon nanotubes: Purification, morphology and field emission performance", Physica E, vol. 40, pp. 2322-2326, 2008.
Butter et al., "Direct observation of dipolar chains in ferrofluids in zero field using cryogenic electron microscopy", Journal of Physics: Condensed Matter, vol. 15, pp. S1451-S1470, 2003.
Correa-Duarte, et al., "Alignment of Carbon Nanotubes under low magnetic fields through attachment of magnetic nanoparticles", J. Phys. Chem. B, vol. 109, No. 41, pp. 19060-19063, Sep. 24, 2005, 3 pages, can be found at http://pubs.acs.org/doi/abs/10.1021/jp0544890.
RJ Nicholas, "Carbon Nanotubes", 10 pages, 2014/2015, can be found at http://www2.physics.ox.ac.uk/sites/default/files/BandMT_08.pdf.
Datsyuk et al., "Chemical oxidation of multiwalled carbon nanotubes", Carbon 46, pp. 833-840, 2008, can be found at http://www.sciencedirect.com/science/article/pii/S0008622308000717.
Balasubramanian et al., "Chemically Functionalized Carbon Nanotubes", Small, vol. 1, No. 2, pp. 180-192, 2005.
Mansor et al., "Chemically Modified Multi-walled Carbon Nanotubes (MWCNTs) with Anchored Acidic Groups", Sains Malaysiana, vol. 41, No. 5, pp. 603-609, 2012.
Paiva et al., "Controlled Functionalization of Carbon Nanotubes by a Solvent-free Multicomponent Approach", Acsnano, vol. 4, No. 12, pp. 7379-7386, 2010.
Coleman et al., "Electron paramagnetic resonance as a quantitative tool for the study of multiwalled carbon nanotubes", J. Chem. Phys., vol. 113, No. 21, pp. 9788-9793, Dec. 2000, can be found at http://scitation.aip.org/content/aip/journal/jcp/113/21/10.1063/1.1322032?ver=pdfcov.
Petit et al., "Electron spin resonance and microwave resistivity of single-wall carbon nanotubes", Physical Review B, vol. 56, No. 15, pp. 9275-9278, Oct. 1997.
Garaj et al., "Electronic properties of carbon nanohorns studied by ESR", Physical Review B, vol. 62, No. 24, pp. 115-119, Dec. 2000.
Chauvet et al., "ESR study of potassium-doped aligned carbon nanotubes", Physical Review B, vol. 53, No. 21, pp. 996-999, 4 pages, Jun. 1996.
Avilés et al., "Evaluation of mild acid oxidation treatments for MWCNT functionalization", Carbon 47, pp. 2970-2975, 2009, can be found at http://www.sciencedirect.com/science/article/pii/S0008622309003959.
Zhong et al., "Facile Approach for Superparamagnetic CNT-Fe3O4/Polystyrene Tricomponent Nanocomposite via Synergetic Dispersion", Industrial & Engineering Chemistry Research, vol. 51, pp. 12017-12024, 2012.
Smith, "Ferrofluidic Alignment of Carbon Nanotubes", NNIN REU Research Accomplishments, vol. 84, pp. 84-85, 2006.
Worsley et al., "Functionalization and Dissolution of Nitric Acid Treated Single-Walled Carbon Nanotubes", J. AM. Chem. Soc., vol. 131, pp. 18153-18158, 2009.
Naseh et al., "Functionalization of Carbon Nanotubes Using Nitric Acid Oxidation and DBD Plasma", International Journal of Chemical and Biological Engineering, 2:2, pp. 66-68, 2009.
Cunha, et al., "Hybrid composites made of multiwalled carbon nanotubes functionalized with Fe3O4 nanoparticles for tissue engineering applications", Nanotechnology 23, 11 pages, 2012.
Kim et al., "Magnetic Carbon Nanotubes: Synthesis, Characterization and Anisotropic Electrical Properties", Georgia Institute of Technology, 23 pages, 2011, can be found at , www.intechopen.com.
M. Meyyappan, "Nanotechnology in Silicon CMOS Fabrication and Nanoelectronics", Ames Research Center, 40 pages, 2006.
Goze-Bac et al., "Magnetic interactions in carbon nanostructures", Carbon 40, pp. 1825-1842, 2002.
Qu et al., "Magnetic loading of carbon nanotube/nano-Fe3O4 composite for electrochemical sensing", Talanta 71, pp. 1096-1102, 2007.
Shunji Bandow, "Magnetic properties of nested carbon nanostructures studied by electron spin resonance and magnetic susceptibility measurements", J. Appl. Phys. 80 (2), pp. 1020-1027, Jul. 15, 1996, can be found at http://scitation.aip.org/content/aip/journal/jap/80/2/10.106311.362835?ver=pdfcov.
Li et al., "Magnetorheology of single-walled nanotube dispersions", Materials Letters 61, pp. 3116-3118, 2007, can be found at http://www.sciencedirect.com/science/article/pii/S0167577X06013152.
Lee et al., "Measurement of the dispersion stability of pristine and surface-modified multiwalled carbon nanotubes in various nonpolar and polar solvents", Measurement Science and Technology 18, pp. 3707-3712, 2007 and can be found at http://iopscience.iop.org/article/10.1088/0957-0233/18/12/005/meta;jsessionid=73D467B3C6453694503465D97D78 BF87.c1.
Beuneu et al., "Modification of multiwall carbon nanotubes by electron irradiation: An ESR study", Physical Review B, vol. 59, No. 8, pp. 5945-5949, Feb. 15, 1999.
Narayanan et al., "On the synthesis and magnetic properties of multiwall carbon nanotube—superparamagnetic iron oxide nanoparticle nanocomposites", Nanotechnology 20, 2009, 8 pages, can be found at http://iopscience.iop.org/article/10.1088/0957-4484/20/5/055607/metajsessionid=DE5E3ACE64AD1D4B61774F5E05BBA8AD.c1.
Dresselhaus et al., "Physics of Carbon Nanotubes", Carbon, vol. 33, No. 7, pp. 883-891, 1995.
He et al., "Polyaniline-Functionalized Carbon Nanotube Supported Platinum Catalysts", Langmuir, 27, pp. 5582-5588, 2011.
Hou et al., "Purification of carbon nanotubes", Carbon 46, pp. 2003-2025, 2008.
Hernández et al., "Side-Wall Functionalization of Multi-Walled Carbon Nanotubes with t-Butyl Diazoacetate", J. Mex. Chem. Soc., vol. 55, No. 1, pp. 7-10, 2011.
Duclaux et al., "Synthesis and characterization of SWNT-heavy alkali metal intercalation compounds, effect of host SWNTs materials", Journal of Physics and Chemistry of Solids, vol. 64, pp. 571-581, 2003.
Seelan et al., "Synthesis of multiwalled carbon nanotubes by high-temperature vacuum annealing of amorphous carbon" Vacuum vol. 75, pp. 105-109, 2004.
Kim et al., "Synthesis, Characterization, and Alignment of Magnetic Carbon Nanotubes Tethered with Maghemite Nanoparticles", J. Phys. Chem. C vol. 114, pp. 6944-6951, 2010.
Ochiai et al., "Thermal annealing effect in multi-wall carbon nanotubes", Physica B, vol. 323, pp. 256-258, 2002.
Raj et al., "Commercial Applications of Ferrofluids", Journal of Magnetism and Magnetic Materials, vol. 85, pp. 233-245, 1990.
Pérez-Castillejos et al., "The use of ferrofluids in micromechanics", Sensors and Actuators vol. 84, pp. 176-180, 2000.
Pankhurst et al., "Applications of magnetic nanoparticles in biomedicine", Journal of Physics D: Applied Physics, vol. 36, pp. R167-R181, 2003.
Raj et al., "New commercial trends of nanostructured ferrofluids", Indian Journal of Engineering & Material Sciences, vol. 11, pp. 241-252, Aug. 2004.
Kim et al., "Synthesis of ferrofluid with magnetic nanoparticles by sonochemical method for MRI contrast agent", Journal of Magnetism and Magnetic Materials, vol. 289, pp. 328-330, 2005.
Dobson et al., "Magnetic Nanoparticles for Drug Delivery", Drug Development Research, vol. 67, pp. 55-60, 2006.

(56) References Cited

OTHER PUBLICATIONS

Arruebo et al., "Magnetic nanoparticles for drug delivery", Nano Today, vol. 2, No. 3, pp. 22-32, Jun. 2007.
Lijima, et al. "Helical microtubules of graphitic carbon", Nature, vol. 354, pp. 56-58, Nov. 1991.
Ebbesen et al., "Electrical conductivity of individual carbon nanotubes", Nature, vol. 382, pp. 54-56, Jul. 1996.
Wan et al., "Optical properties of carbon nanotubes", Physical Review B, vol. 58, No. 11, pp. 6756-6759, 1998.
Hone, et al., "Thermal conductivity of single-walled carbon nanotubes", Physical Review B, vol. 59, No. 4, pp. R2514-R2516, Jan. 1999.
Kataura et al., "Optical Properties of Single-Wall Carbon Nanotubes", Synthetic Metals, vol. 103, pp. 2555-2558, 1999.
Berber et al., "Unusually High Thermal Conductivity of Carbon Nanotubes", Physical Review Letters, vol. 84, No. 20, pp. 4613-4616, 2000.
Correa-Duarte et al., "Alignment of Carbon Nanotubes under Low Magnetic Fields through Attachment of Magnetic Nanoparticles", Journal of Physical Chemistry B, vol. 109, No. 41, pp. 19060-19063, 2005.
Korneva et al., "Carbon Nanotubes Loaded with Magnetic Particles", Nano Letters, vol. 5, No. 5, pp. 879-884, 2005.
Kim et al., "Anisotropic conductivity of magnetic carbon nanotubes embedded in epoxy matrices", Carbon, vol. 49, pp. 54-61, 2011.
Jimenez et al., "A simple drain current model for Schottky-barrier carbon nanotube field effect transistors", Nanotechnology, vol. 18, 8 pages, 2007, can be found at http://iopscience.iop.org/article/10.1088/0957-4484/18/2/025201/meta;jsessionid=81D30ED697216697077F5FDAB56085D6.01.

* cited by examiner

FERROFLUID-MWCNT HYBRID NANOCOMPOSITE IN LIQUID STATE

FIELD OF THE INVENTION

The present invention relates to a Ferrofluid-MWCNT (multiwall carbon nano tube) hybrid nanocomposite in liquid state. Particularly, present invention relates to the chemical synthesis of stable dispersions comprising $Fe_3O_4$ nanoparticles and functionalized MWCNTs in aqueous phase.

More particularly, present invention relates to nanocomposite in liquid state useful for various applications like MRI, EMI shielding, energy conversion etc.

BACKGROUND OF THE INVENTION

The stable fluidic dispersions of magnetic nanoparticles especially, ferrofluids have been conscientiously investigated in recent years for their numerous potential applications. Their remarkable magnetoviscous effects have made them highly desirable for scientific and engineering applications e.g. vacuum seals (Journal of Magnetism and Magnetic Materials, 1990, v. 85, no. 1-3, p. 233-245), microelectromechanical systems (MEMS) (Sensors and Actuators A: Physical, 2000, v. 84, no. 1, p. 176-180), magnetic hyperthermia (Journal of physics D: Applied physics, 2003, v. 36, no. 13, p. R167), hearing aids (Indian Journal of Engineering and Materials Sciences, 2004, v. 11, p. 241-252), contrast enhancement in MRI (Journal of Magnetism and Magnetic Materials, 2005, v. 289, p. 328-330), drug delivery and its targeting (Drug Development Research, 2006, v. 67, no. 1, p. 55-60; Nano Today, 2007, v. 2, no. 3, p. 22-32) etc. have been explored. On the other hand, since the historic discovery of carbon nanotubes (CNTs) by Ijima (Nature, 1991, v. 354, p. 56-58), there has been great interests towards its unique electrical, thermal, optical and mechanical properties (Nature, 1996, v. 382, p. 54-56.; Physical Review B, 1998, v. 68, p. 6756-6759; Physical Review B, 1999, v. 59, no. 4, p. 82514; Synthetic Metals, 1999, v. 103, p. 2555-2558; Physical Review Letters, 2000, v. 84, no. 20, p. 4613). Instead, a fewer attempts have been given to enhance their magnetic properties (The Journal of Physical Chemistry B, 2005b, v. 109, no. 41, p. 19060-19063; Nano Letters, 2005, v. 5, no. 5, p. 879-884; Nanotechnology, 2009, v. 20, no. 5, p. 055607; The Journal of Physical Chemistry C, 2010, v. 114, no. 15, p. 6944-6951, Kim, I. T., and R. Tannenbaum, 2011, www.intechopen.com; Magnetic Carbon Nanotubes: Synthesis, Characterization, and Anisotropic Electrical Properties; Carbon, 2011, v. 49, no. 1, p. 54-61).

In U.S. Pat. No. 6,975,063, methods are presented for the metallization of carbon nanotubes for field emission applications. The metallization procedure involves an electrodless plating technique for depositing thin metal layers of few nanometers on SWCNT, MWCNT, etc. Thereafter, dispensing the dispersed mixtures of metallized carbon nanotubes onto any suitable substrate for a thin coating of this material. The presence of magnetic field initiates the alignment of magnetically-active metallized carbon nanotubes. The present invention also directs method for cold cathode field emitting materials comprising metallized carbon nanotubes and using metallized carbon nanotubes as cold cathode field emitters.

In U.S. Pat. No. 8,038,926, the carbon nanotubes with embedded gold, SiC and $Fe_3O_4$ nanoparticles are produced. Initially a template of anodized porous aluminum oxide membrane (pore diameter of 20-200 nm) is placed in a solution of desired nanoparticles followed by sonication. The template is separated by treatment to a basic solution and a carbon structure via chemical deposition of carbon on the template is formed.

In U.S. Pat. No. 8,119,021, the nanotubes prepared via chemical vapor deposition on alumina template were loaded with functionally active gold and $Fe_3O_4$ nanoparticles. The application of magnetic field therein helps in manipulation of CNTs encapsulated with magnetic particles, drugs or quantum dots.

In U.S. Pat. No. 8,325,079, a radar absorbing (0.1-60 MHz) composite material includes a (CNT)-infused fiber material. The material exhibits radar reflectance as well as dissipation of radar energy in a systematic layer by layer coated form.

The general drawbacks of hitherto known ferrofluid-CNT composites is that they are all in solid state. The manipulation of such homogenized composite in a well dispersed liquid state can give more flexibility in its magnetic and electrical response as mentioned below.

In U.S. Pat. No. 6,975,063, inventors have utilized the carbon nanotubes metallized with magnetically active, in thin coated form for cathode field emitters. A thin metallic coating induces the magnetic response in the prepared composite.

In U.S. Pat. No. 8,038,926, a composite material comprising carbon nanotubes with embedded with magnetic nanoparticles, is prepared in dried state. The size selection of nanoparticles ranges from 20-200 nm, depending on porosity of template.

In U.S. Pat. No. 8,119,021, empty carbon nanotubes have been loaded with functionalized magnetic nanoparticles for carrying out desired magnetic manipulation.

In U.S. Pat. No. 8,325,079, a CNT-infused fiber material is used in coated form for radar absorbing applications.

Our invention provides a new method to prepare a stable new hybrid nanofluid comprising a composite of ferrofluid and functionalized MWCNT. In each of these earlier inventions, the preparation of this magnetic composite has been described in dried state. This limits the control orientation of CNTs loaded with nano-magnetic particles. A homogeneous distribution of CNTs is not achievable in dried state. Further, the uniform coating of CNTs loaded with magnetic particles is not attainable in dried state. None of the inventors has prepared the ferrofluid-MWCNT composite in liquid state. The present method is successful in synthesis of this composite and its stable dispersion in water. Therefore, the preparation method resulting in aqueous dispersion of ferrofluid-MWCNT composite is unique and opens door for several other possible applications.

OBJECTIVES OF THE INVENTION

The main object of the present invention is to provide a stable a Ferrofluid-MWCNT (multiwall carbon nano tube) hybrid nanocomposite in liquid state.

Another object of the present invention is to provide two different processes for the preparation of stable aqueous dispersions of MWCNTs and magnetite nanoparticles separately.

Still another object of the present invention is to provide a process wherein we can efficiently functionalize MWCNTs without much damaging graphene layer organization for compatibility with ferrofluid dispersion.

Yet another object of the present invention is to use nitric acid as the only source for functionalization of outer nanotube layer.

Yet another object of the present invention is to stabilize magnetite nanoparticles in aqueous medium.

Yet another object of the present invention is to synthesize double surfactant coated magnetite nanoparticles.

Still another object of the present invention is to provide a process wherein we can have both MWCNTs and magnetite nanoparticles in same system.

Yet another object of the present invention is to provide a fluid which has constituents having both electrical and magnetic properties.

SUMMARY OF THE INVENTION

Accordingly, present invention provides a $Fe_3O_4$-MWCNT hybrid nanocomposite in liquid state comprising water based ferrofluid in fixed volume concentration and MWCNT in the ratio ranging between 1 to 30.

In an embodiment, present invention provides a process for the preparation of $Fe_3O_4$-MWCNT hybrid nanofluid comprising the steps of:

i. mixing ferrous sulphate heptahydrate and ferric chloride in the ratio 1:2 with a mixture of 25% (v/v) ammonia and in presence of primary surfactant and emulsifier followed by heating at temperature in the range of 30 to 60° C., magnetic decantating and washing to obtain a mixture;

ii. adding secondary surfactant dissolved in water at temperature in the range of 30 to 50° C. in the mixture as obtained in step (i) followed by centrifuging to obtain $Fe_3O_4$ dispersion;

iii. treating MWCNTs with $HNO_3$ and heating at temperature in the range of 25 to 30° C. for period in the range of 150 to 180 min followed by filtering and washing to obtain dried MWCNTs;

iv. treating dried MWCNTs as obtained in step (iii) with $HNO_3$ followed by sonicating; heating at temperature in the range of 80 to 90° C. for a period in the range of 55 to 65 hours, cooling filtering and washing to obtain filtered product;

v. dispersing the filtered product as obtained in step (iv) in water to obtain MWCNT dispersion;

vi. mixing dispersions as obtained in step (ii) and (v) in the volume ratio between 1 to 30 using mechanical stirring to obtain $Fe_3O_4$-MWCNT hybrid nanofluid.

In another embodiment of the present invention, emulsifier used is acetone.

In yet another embodiment of the present invention, primary surfactant used is oleic acid.

In yet another embodiment of the present invention, secondary surfactant used is sodium oleate.

In yet another embodiment of the present invention, ion-dipole interaction between $Fe_3O_4$-MWCNTs leads to stable suspension.

BRIEF DESCRIPTION OF THE DRAWING

In FIG. 1, these are a, b and c respectively.

DETAILED DESCRIPTION OF THE INVENTION

Figure 1:
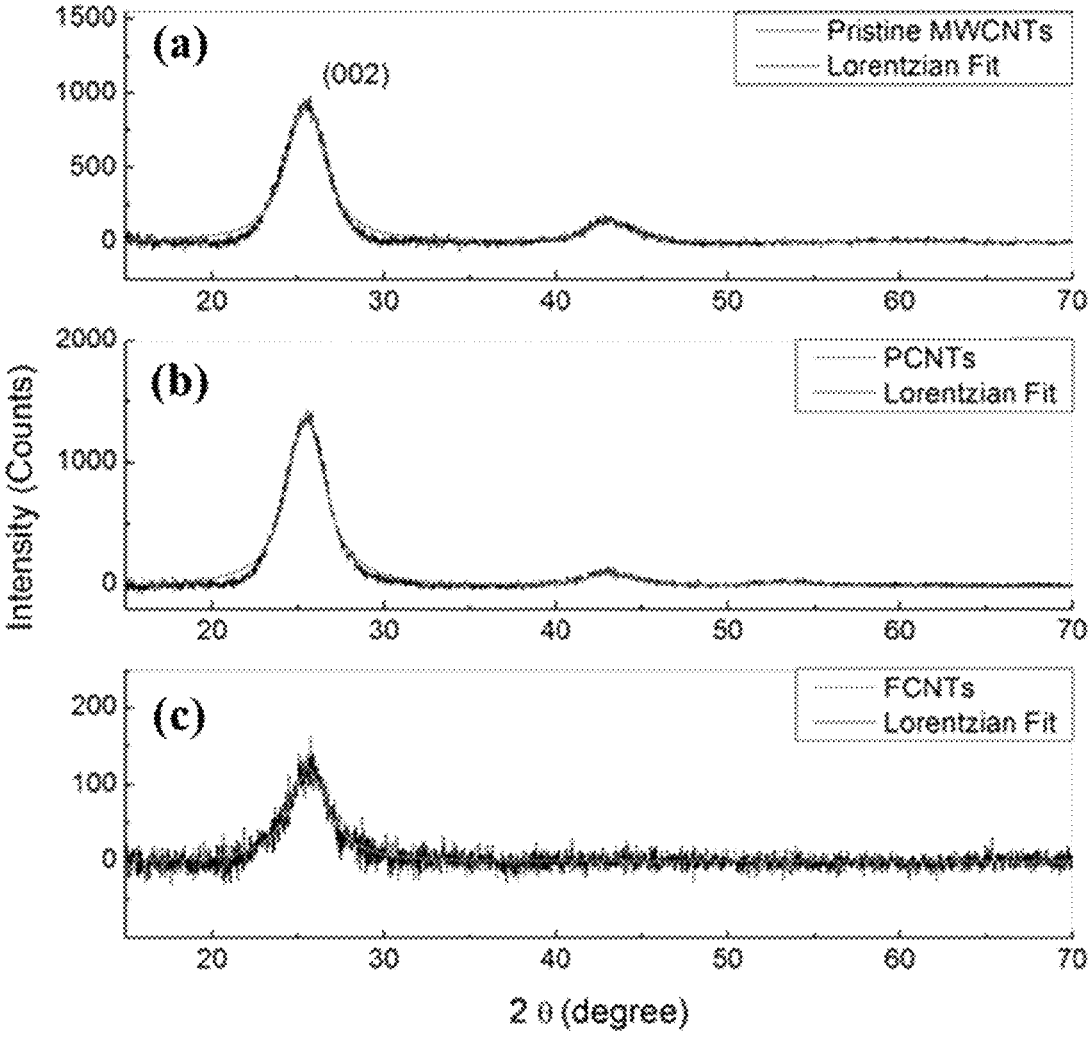
FIG. 1 XRD pattern of (a) pristine, (b) purified and (c) functionalized MWCNTs with lorentzian fits.

Present invention provides a stable hybrid nanofluid of $Fe_3O_4$ and MWCNTs, which comprises the preparation of aqueous dispersions of $Fe_3O_4$ nanoparticles and MWCNTs separately and thereafter, mixing of both components using mechanical stirring.

The synthesis of $Fe_3O_4$ nanoparticles was performed using reverse micelles of primary surfactant oleic acid in aqueous medium.

The prepared coated nanoparticles were coated with sodium oleate as secondary surfactant for dispersibility in water.

The mild acidic conditions created via nitric acid in a stepwise manner yields purified and functionalized MWCNTs and finally its stable aqueous dispersion.

According to the present invention, a stable hybrid was prepared after the preparation of dispersions of magnetite nanoparticles and MWCNTs in water. The water based ferrofluid was synthesized by taking $Fe^{2+}$ and $Fe^{3+}$ ions (1:2 molar ratio) in aqueous phase in presence of surfactant and emulsifier. The MWCNTs were purified and functionalized by mild acid treatment and dispersed in deionized water. The present invention describes a simple preparation of hybrid nanofluid of $Fe_3O_4$ nanoparticles and MWCNTs in aqueous medium. The simultaneous use of oleic acid and acetone as primary surfactant and emulsifier for the preparation of single layer coated magnetite nanoparticles. Thereafter, sodium oleate is coated as secondary surfactant. On the other side, a mild acid treatment to MWCNTs by $HNO_3$ leads to efficient functionalization of sidewalls. This step is very important in obtaining a stable dispersion of MWNCTs. Thereafter, both dispersions were mixed in different volume ratios for desired nanoparticle to MWCNTs content in the hybrid fluid.

The process of the invention involves i) reaction of ferrous sulphate heptahydrate and ferric chloride with a mixture of 25% (v/v) ammonia, ii) heating of reaction mixture at 70° C., iii) magnetic decantation followed by washing by deionized water (2 L), iv) 3.85 g of sodium oleate dissolved in 20 mL deionized water at 50° C., v) the slurry was added to above mixture, vi) the final mixture is centrifuged at 13000 rpm and supernatant separated.

The process of the invention also involves i) treatment of 0.03 g of MWCNTs with 150 mL of 69% $HNO_3$ and heated at 50° C. for 180 min. ii) The MWCNTs were filtered and washed with deionized water iii) The as obtained dried MWCNTs were treated with 200 mL of 69% $HNO_3$ and sonicated at 35 kHz iv) The mixture is heated 90° C. for 65 hours and allowed to cooled down on its own. v) the obtained solution is filtered and washed using deionized water, vi) the filtered product was dispersed in 300 mL of deionized water.

Thereafter, both dispersions obtained by these two process were mixed in different volume ratios for desired nanoparticle to MWCNTs content in the hybrid fluid.

The Inventive Steps Involved in the Present Invention are i. A double surfactant water based ferrofluid is prepared using oleic acid and sodium oleate as primary and secondary surfactants respectively,
ii. their attachment in reverse manner due to Van der Waals force of interaction between hydrophobic tail allows a stable dispersion in water,
iii. both the surfactants and reaction medium i.e. water are readily and cheaply available
iv. the size of reverse micelle formed by sonication decides the size of nano reactors in which nanoparticles are formed
v. mild conditions for purification and functionalization of MWCNTs is illustrated
vi. use of only nitric acid is shown without any further requirement of other oxidizing agents such as $KMnO_4$, sulfuric acid, $H_2O_2$ etc.
vii. Separate stable dispersions of nanoparticles and nanotubes were synthesized and mixed for preparing final hybrid fluid, excluding any complex reaction at initial stages between the two components.

EXAMPLES

Following examples are given by way of illustration and therefore should not be construed to limit the scope of the invention.

Example 1

Initially 0.03 g of as obtained MWCNTs were treated with 150 mL of 69% $HNO_3$ and sonicated at 35 kHz for half an hour. Then it was followed by 180 min. magnetic stirring at room temperature i.e. 25° C. The mixture was filtered and washed with MILLI-Q® purified water till pH reaches 6. The slurry was dried at 70° C. for 24 hours and labeled as PCNT. For chemical oxidation on side walls, some part of PCNT was taken in 200 mL of 69% $HNO_3$ followed by sonication and then heating at 90° C. for 65 hours under constant stirring. After this second stage of acid treatment, the acid mixture containing functionalized carbon nanotubes (FCNTs) was allowed to cool down to room temperature and washed carefully by MILLI-Q® purified water using two layers of Whatman filter paper (grade no. 42). The washing was continued with 3 liters of water till it pH reaches 6. The slurry was transferred to 350 mL of distilled water. It was found that the MWCNTs readily disperse in water without any further treatment. The dispersion was labelled as WCNT.

In the other synthesis procedure, 15.9 g $FeCl_3$ and 14.0 g $FeSO_4.7H_2O$ were dissolved in 100 mL 100 mL MILLI-Q® purified water along with 4 mL oleic acid as primary surfactant and 1 mL acetone as emulsifier to form oil-in-water emulsion. The mixture was then heated from 30° C. to 60° C. at 2° C./min heating rate under rigorous stirring. During heating, 22 mL of 25% aq. $NH_3$ was added dropwise. The precipitate was separated magnetically from mixture and washed with 700 mL hot MILLI-Q® purified water (200° C.) to remove unwanted ions. The slurry was then dried at 100° C. Simultaneously on the other side, a 20 mL aqueous solution of sodium oleate (3.47 g) as secondary surfactant was prepared by heating at 50° C. for 10 min. The dried slurry of previously obtained nanoparticles was transferred to above solution and heated for further 10 min. Then this mixture was allowed to cool down to room temperature and later on centrifuged at 13500 rpm for 20 min. The filtrate was separated carefully via pipette and labeled as WFF. The dispersions WCNT and WFF were mixed in v/v ratio 1:1 to obtain desired MWCNT-$Fe_3O_4$ hybrid composites in well a dispersed liquid state.

Example 2

Initially 0.03 g of as obtained MWCNTs were treated with 150 mL of 69% HNO3 and sonicated at 35 kHz for half an hour. Then it was followed by 180 min. magnetic stirring at room temperature i.e. 27° C. The mixture was filtered and washed with MILLI-Q® purified water till pH reaches 6. The slurry was dried at 70° C. for 24 hours and labeled as PCNT. For chemical oxidation on side walls, some part of PCNT was taken in 200 mL of 69% HNO3 followed by sonication and then heating at 90° C. for 65 hours under constant stirring. After this second stage of acid treatment, the acid mixture containing functionalized nanotubes (FCNTs) was allowed to cool down to room temperature and washed carefully by MILLI-Q® purified water using two layers of Whatman filter paper (grade no. 42). The washing was continued with 3 liters of water till it pH reaches 6. The slurry was transferred to 350 mL of distilled water. It was found that the MWCNTs readily disperse in water without any further treatment. The dispersion was labelled as WCNT.

In the other synthesis procedure, 15.9 g $FeCl_3$ and 14.0 g $FeSO_4.7H_2O$ were dissolved in 100 mL 100 mL MILLI-Q® purified water along with 4 mL oleic acid as primary surfactant and 1 mL acetone as emulsifier to form oil-in-water emulsion. The mixture was then heated from 30° C. to 60° C. at 2° C./min heating rate under rigorous stirring. During heating, 22 mL of 25% aq. $NH_3$ was added dropwise. The precipitate was separated magnetically from mixture and washed with 700 mL hot MILLI-Q® purified water (200° C.) to remove unwanted ions. The slurry was then dried at 100° C. Simultaneously on the other side, a 20 mL aqueous solution of sodium oleate (3.47 g) as secondary surfactant was prepared by heating at 50° C. for 10 min. The dried slurry of previously obtained nanoparticles was transferred to above solution and heated for further 10 min. Then this mixture was allowed to cool down to room temperature i.e. 25° C. and later on centrifuged at 13500 rpm for 20 min. The filtrate was separated carefully via pipette and labeled as WFF. The dispersions WCNT and WFF were mixed in v/v ratio 1:2 to obtain desired MWCNT-Fe3O4 hybrid composites in well a dispersed liquid state.

Example 3

Initially 0.03 g of as obtained MWCNTs were treated with 150 mL of 69% $HNO_3$ and sonicated at 35 kHz for half an hour. Then it was followed by 180 min. magnetic stirring at room temperature i.e. 30° C. The mixture was filtered and washed with MILLI-Q® purified water till pH reaches 6. The slurry was dried at 70° C. for 24 hours and labeled as PCNT. For chemical oxidation on side walls, some part of PCNT was taken in 200 mL of 69% $HNO_3$ followed by sonication and then heating at 90° C. for 65 hours under constant stirring. After this second stage of acid treatment, the acid mixture containing functionalized nanotubes (FCNTs) was allowed to cool down to room temperature and washed carefully by MILLI-Q® purified water using two layers of Whatman filter paper (grade no. 42). The washing was continued with 3 liters of water till it pH reaches 6. The slurry was transferred to 350 mL of distilled water. It was found that the MWCNTs readily disperse in water without any further treatment. The dispersion was labelled as WCNT.

In the other synthesis procedure, 15.9 g $FeCl_3$ and 14.0 g $FeSO_4.7H_2O$ were dissolved in 100 mL 100 mL MILLI-Q® purified water along with 4 mL oleic acid as primary surfactant and 1 mL acetone as emulsifier to form oil-in-water emulsion. The mixture was then heated from 30° C. to 60° C. at 2° C./min heating rate under rigorous stirring. During heating, 22 mL of 25% aq. $NH_3$ was added dropwise. The precipitate was separated magnetically from mixture and washed with 700 mL hot MILLI-Q® purified water (200° C.) to remove unwanted ions. The slurry was then dried at 100° C. Simultaneously on the other side, a 20 mL aqueous solution of sodium oleate (3.47 g) as secondary surfactant was prepared by heating at 50° C. for 10 min. The dried slurry of previously obtained nanoparticles was transferred to above solution and heated for further 10 min. Then this mixture was allowed to cool down to room temperature and later on centrifuged at 13500 rpm for 20 min. The filtrate was separated carefully via pipette and labeled as WFF. The dispersions WCNT and WFF were mixed in v/v ratio 1:10 to obtain desired MWCNT-$Fe_3O_4$ hybrid composites in well a dispersed liquid state.

Example 4

Initially 0.03 g of as obtained MWCNTs were treated with 150 mL of 69% $HNO_3$ and sonicated at 35 kHz for half an hour. Then it was followed by 180 min. magnetic stirring at room temperature i.e. 25° C. The mixture was filtered and washed with MILLI-Q® purified water till pH reaches 6. The slurry was dried at 70° C. for 24 hours and labeled as PCNT. For chemical oxidation on side walls, some part of PCNT was taken in 200 mL of 69% $HNO_3$ followed by sonication and then heating at 90° C. for 65 hours under constant stirring. After this second stage of acid treatment, the acid mixture containing functionalized nanotubes (FCNTs) was allowed to cool down to room temperature and washed carefully by MILLI-Q® purified water using two layers of Whatman filter paper (grade no. 42). The washing was continued with 3 liters of water till it pH reaches 6. The slurry was transferred to 350 mL of distilled water. It was found that the MWCNTs readily disperse in water without any further treatment. The dispersion was labelled as WCNT.

In the other synthesis procedure, 15.9 g $FeCl_3$ and 14.0 g $FeSO_4.7H_2O$ were dissolved in 100 mL 100 mL MILLI-Q® purified water along with 4 mL oleic acid as primary surfactant and 1 mL acetone as emulsifier to form oil-in-water emulsion. The mixture was then heated from 30° C. to 60° C. at 2° C./min heating rate under rigorous stirring. During heating, 22 mL of 25% aq. $NH_3$ was added dropwise. The precipitate was separated magnetically from mixture and washed with 700 mL hot MILLI-Q® purified water (200° C.) to remove unwanted ions. The slurry was then dried at 100° C. Simultaneously on the other side, a 20 mL aqueous solution of sodium oleate (3.47 g) as secondary surfactant was prepared by heating at 50° C. for 10 min. The dried slurry of previously obtained nanoparticles was transferred to above solution and heated for further 10 min. Then this mixture was allowed to cool down to room temperature and later on centrifuged at 13500 rpm for 20 min. The filtrate was separated carefully via pipette and labeled as WFF. The dispersions WCNT and WFF were mixed in v/v ratio 1:30 to obtain desired MWCNT-$Fe_3O_4$ hybrid composites in well a dispersed liquid state.

Characterization

The structural characterization was performed by Rigaku powder X-ray diffractometer with Cu-Kα radiation (λ=1.54059 Å), 40 kV & 30 mA with step size 0.002°, scan rate 2°/min, scan range (2θ) from 15°-80°. For these measurements, the oleic acid coated NPs prepared in synthesis were separated and dispersed in kerosene. The supernatant of the suspension was allowed to evaporate on a 1×1 $cm^2$ glass slide at room temperature. The XRD pattern of dispersed MWCNT in WCNT sample was recorded by drying its few drops on glass slides in ambient conditions. On the other hand, as obtained MWCNT and purified MWCNT were used in powder form for recording their XRD pattern. The surface morphology of nanoparticles, nanotubes and nanocomposite was examined with a SEM model LEO 440 PC based.

The specimens were prepared by leaving few drops of required dispersions on 1×1 $cm^2$ surgical glass slides and allowed to dry in an experimental setup with specified magnetic field at room temperature. The closer morphological details of samples were recorded via M/s Tecnai F30 HRTEM. The specimens for HRTEM characterization were prepared by leaving few drops of the desired dispersions on carbon-coated Cu-TEM grid (400 meshes). The wet TEM grid was allowed to evaporate at room temperature. After drying, the specimen was transferred into microscope for imaging.

The XRD patterns of as such obtained, purified and functionalized MWCNTs are shown in FIG. 1. The main diffraction peaks at 2θ=25.3° and 43.6° (JCPDS card 41-1487) correspond to reflections of (002) and (101) crystallographic planes respectively. The peaks were fitted with Lorentzian function to get 2θ and β values (FWHM). The broadness of (002) peak can be explained due to the high curvature and limited number graphitic planes in each tube. The average coherence length or mean crystalline size along the c-axis ($L_c$) of MWCNTs can be deduced from the width of the (002) Bragg peaks using Debye-Scherrer equation (Carbon, 2001, v. 39, no. 8, p. 1273-1278; Chemical Communications, 2012, v. 48, no. 54, p. 6836)

$$L_c = \frac{0.9\lambda}{\beta\cos\theta} \tag{1}$$

The λ, β and θ corresponds to X-ray wavelength and FWHM in radians and Bragg's angle respectively. FIG. 1 (*a*) shows the typical structural features of a MWCNT which can be find out using eq. 1 and 2. The calculated values of $L_c$ in differently treated MWCNTs as shown in table 1, indicates that the overall crystalline organization of carbon atoms in graphene layers is slightly affected during carboxylic group functionalization by acid treatment. Now, one can imagine a mean wall thickness or say the mean number of graphitic walls (N) which can be calculated by using eq. 2 (Nanotechnology, 2007, v. 18, p. 25201; Physica E, 2007, v. 37, p. 44-48).

$$N = \frac{L_c}{d_{(002)}} \tag{2}$$

TABLE 1

The deduced and calculated parametres from XRD pattern and using eq. 1 and 2.

| Sample | 20 (degree) | β (degree) | Average coherence length, $L_c$ (nm) | Mean number of graphitic walls, N |
|---|---|---|---|---|
| Pristine MWCNT | 25.44 | 2.58 | 3.39 ± 0.44 | 9.8 |
| Purified MWCNT | 25.48 | 2.32 | 3.29 ± 0.43 | 9.4 |
| Functionalized MWCNT | 25.64 | 1.96 | 3.13 ± 0.41 | 9.0 |

The calculated value of N comes out to be 9.7, 9.4 and 9.0 for pristine, purified and functionalized MWCNTs. These results indicates that the reaction procedure involves damage to the graphene layer organization, but to a lesser extent. The intensity of (002) peak was found to be reduced in functionalized MWCNTs, when compared with as such and purified MWCNTs. This gives an indication of lower packing fraction caused by introduction of carboxylic group and simultaneous defragmentation and debundling of side walls in the former sample.

Figure 2:
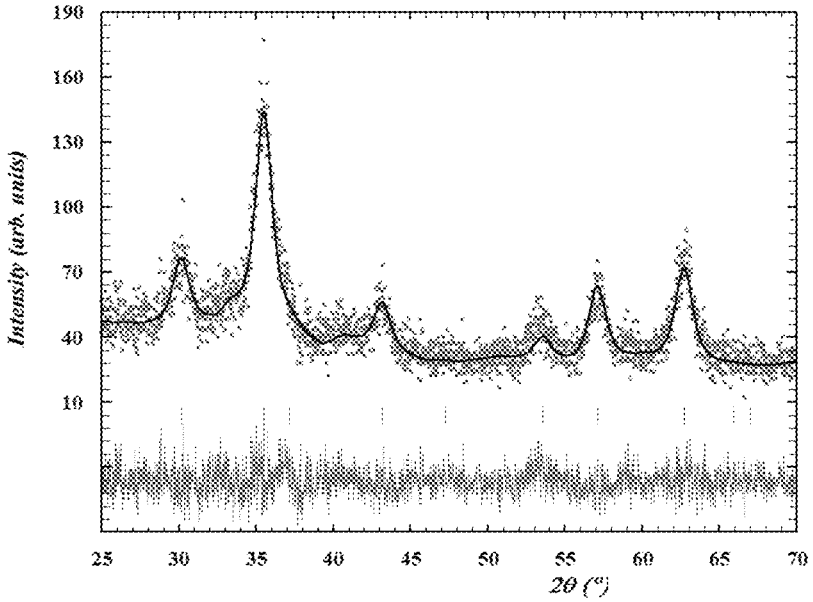
FIG. 2 The Rietveld refinement of XRD pattern of $Fe_3O_4$ nanoparticles.

For MWCNT-ferrofluid composite dried in 1:1 v/v ratio, the recorded diffraction pattern did not show any signature of (002) due to CNTs in the pattern. While intense peaks due to $Fe_3O_4$ nanoparticles is observed only (FIG. 2). This can been explained as overshadowing effect of one phase over other due to large order of crystallinity difference between FCNTs and NPs.

Figure 3:
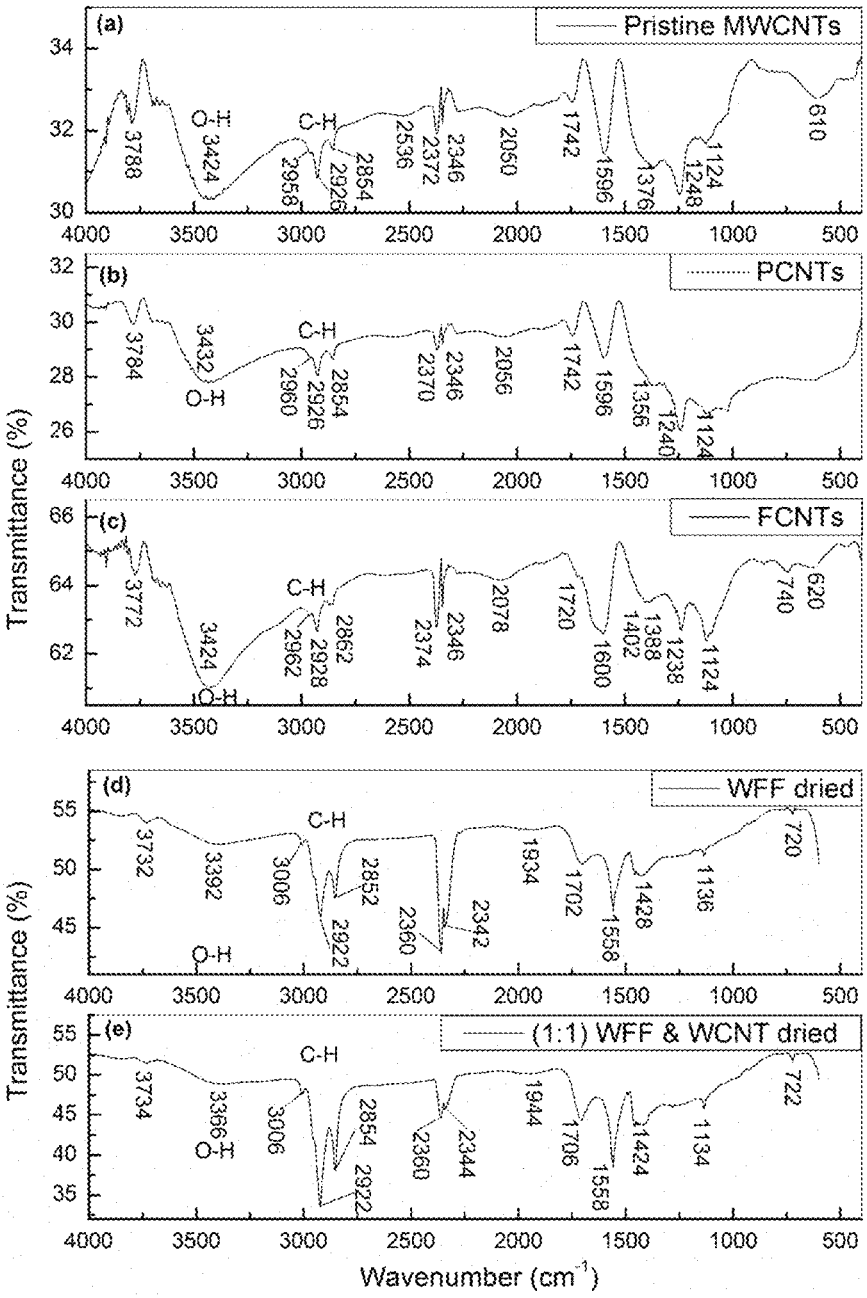
FIG. 3 IR spectra of (a) pristine MWCNTs, (b) Pristine Carbon Nanotubes (PCNTs), (c) Functionalised Carbon Nanotubes (FCNTs) (d) Water based ferrofluid (WFF) and (e) $Fe_3O_4$/MWCNTs.

FTIR spectra of pristine MWCNTs, PCNTs and FCNTs, WFF and $Fe_3O_4$/MWCNTs hybrid fluid were recorded at 298 K and are shown in FIG. 3 (*a-e*). In pristine MWCNTs, PCNTs and FCNTs, a broad peak at ~3430 $cm^{-1}$ appears, which refers to the O—H stretch of hydroxyl groups. The absorption bands around 2860-2960 $cm^{-1}$ can be assigned to the stretching vibrations of $CH_2$ groups (Carbon, 2009, v. 47, no. 13, p. 2970-2975). The two important absorption bands at ~2346-2376 $cm^{-1}$ corresponds to the vibrational and rotational modes of CO and $CO_2$ whose intensity progressively increases with chemical treatment of MWCNTs. It indicates the oxidation of MWCNTs by acid treatments. The absorption band ~1720 $cm^{-1}$ represents the CO stretching of carboxyl groups. In FCNTs it shifts to 1720 $cm^{-1}$ which indicates the involvement of carboxylic groups in hydrogen bonding. The in-plane stretching of conjugated C═C of ring structure comes around 1600 $cm^{-1}$. The peak around 1380 $cm^{-1}$ represents the in-plane bending vibrations of OH group. The absorption peak around 1124 $cm^{-1}$ is due to C—O vibrations, as observed in alcohols (Carbon, 2009, v. 47, no. 13, p. 2970-2975; Digest Journal of Nanomaterials and Biostructures, 2012, v. 7, no. 1, p. 33-39). The peak positions of WFF and $Fe_3O_4$/MWCNTs (FIGS. 3 (*d-e*)) are quite similar to the FCNTs except few notable differences.

It is due to the similarity of hydrocarbon fragments and functional groups in these systems. The intensity of C—H vibrations (2850-3000 $cm^{-1}$) and CO vibrations (2340-2360 $cm^{-1}$) is quite enhanced in the latter samples due to contribution by oleic acid and sodium oleate surfactants. The C═O vibrations, characterized by peak at ~1730 $cm^{-1}$ is sharper in $Fe_3O_4$/MWCNTs as compared to WFF. This behavior can be explained as the result interactions between MWCNTs and $Fe_3O_4$ nanoparticles.

Figure 4:
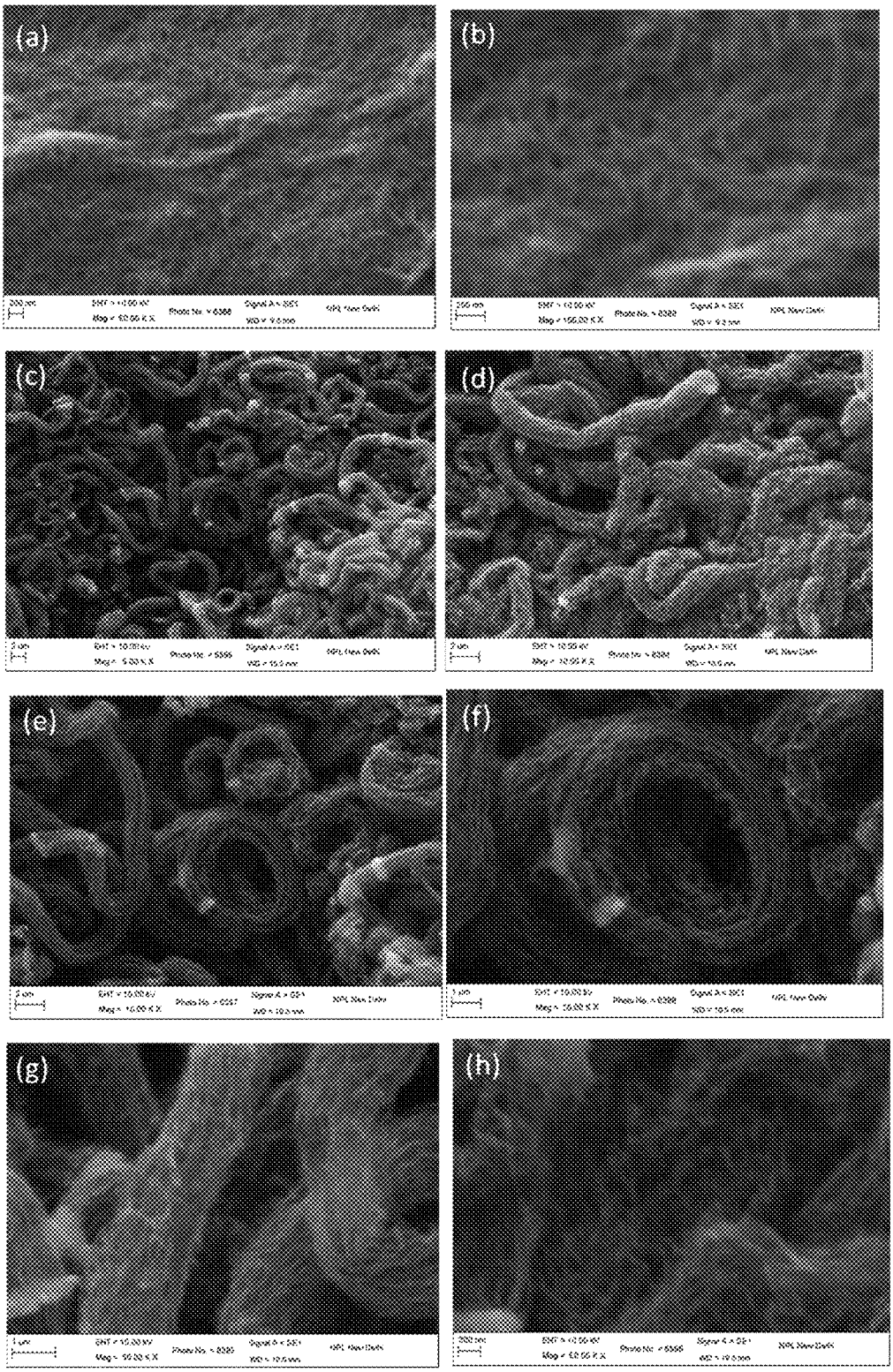
FIG. 4 SEM images of MWCNTs at various stages of chemical treatment and $Fe_3O_4$/FCNTs nanocomposites obtained after drying hybrid fluid having different v/v ratio of ferrofluid and FCNTs dispersion. (a), (b) PCNTs, (c), (d), (e), (f), (g) and (h) FCNTs at different magnifications. (i) 1:2 WFF, /WCNT; H=0 G, (j) 1:2 WFF/WCNT; H=3 kG, (k) 1:30 WFF/WCNT; H=0 G, (l) 1:30 WFF/WCNT; H=3 kG, (m) 1:10 WFF/WCNT; H=0 G, (n) 1:10 WFF/WCNT; H=3 kG. The arrows corresponds to the direction of applied magnetic field (H=3 kG) while absence of any arrow indicates the sample dried in zero field, i.e. H=0 G.
Figure 4:
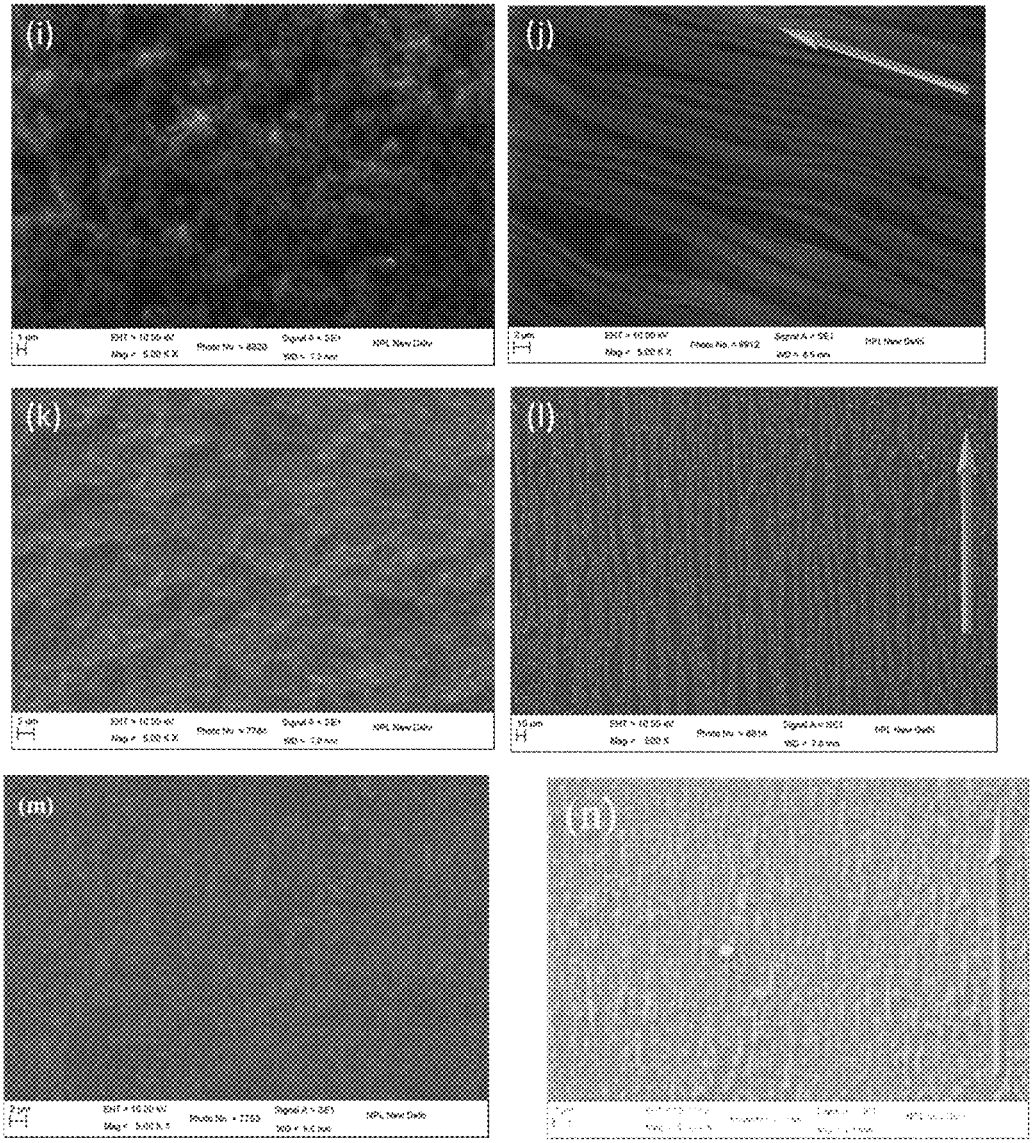

FIG. 4 shows typical SEM images of PCNTs and FCNTs at various magnifications. Images (a) and (b) show curvy and highly entangled nanotubes. Though a number of attempts were made to record images which can give us a reliable idea of average length distribution of nanotubes, but a larger extent of entangling of MWCNTs makes this information inaccessible from this technique. On the other hand, FCNTs (images c-h) show a randomized morphology of highly bundled features, each consisting of hundreds of CNTs with ~1.4 μm and 7-12 μm as diameter and length of individual bundle respectively. The bundles were found with open ends of lighter brightness and contrast when compared with length color of bundles. Similar bundles have been reported with anomalously high emission-current densities (Journal of Vacuum Science and Technology B, 2005, v. 23, no. 1, p. 157-161). On application of electric field, the rearrangement of such bundles in array-like structure have recently shown to have efficient field emission effects (Journal of Vacuum Science and Technology B, 2005, v. 23, no. 1, p. 157-161). In our case, the presence of intertube hydrogen-bonding interactions between carboxylic groups of different nanotubes was found to be the most probable cause of this bundling feature in FCNTs as seen in images (c-h). There are many reports where the evidence of defragmentation and tube damage due to prolonged and harsh acid treatment has been reported (Advanced Materials, 1995, v. 7, no. 3, p. 275-276; Small, 2005 v. 1, no. 2, p. 180-192; Carbon, 2005, v. 43, no. 15, p. 3124-3131; Physica E: Low-dimensional Systems and Nanostructures, 2008, v. 40, no. 7, p. 2322-2326). Such treatment results in scaling down the micron-length nanotubes to minimized small few nanometer range fragments or particle-like carbonaceous material. Although signatures of such degradation of MWCNTs is not clearly visible but the same cannot be totally discarded if occurred to a lesser extent.

To see the manipulation of nanotubes caused by magnetic field, the hybrid fluids were prepared in different ratios viz., 1:2, 1:10 and 1:30 and dried on the glass substrate in two different sets of experimental setup i.e., in the absence (H=0 G) and presence of magnetic field (H=3 kG). The WCNT dispersions were sonicated at 35 kHz frequency for 15 min prior to the mixing with WFF dispersion. This step is followed to avoid any kind of entanglement between FCNTs. The required field was applied by placing the samples in between two rectangular NdFeB permanent magnets. The setup provides a coplanar magnetic field to the sample on glass surface. The other advantage is that the strength of field remains constant over the period of drying. The carrier medium i.e. water, was evaporated off at room temperature. Images (i), (j), (k), (l), (m) and (n) shown in FIG. 4 corresponds to the differently dried typical hybrid fluids.

In the absence of field, a random network of $Fe_3O_4$/FCNTs heterostructure is obtained. It is observed since magnetic moments of $Fe_3O_4$ nanoparticles are randomly oriented in different directions resulting in zero net magnetization. The homogeneity of nanosized constituents in dried composites seems to remain unaffected with respect to v/v ratio of mixed WFF and WCNT dispersions (images i and k).

In the presence of field, a long and orderly dried linear fibrous structure of FCNTs was observed (images j, l and n). This structural transformation of the composites in presence of field occurs due to the alignment of magnetic moments of nanoparticles, which are concomitantly interacting with functional groups of nanotubes (The Journal of Physical Chemistry B, 2005b, v. 109, no. 41, p. 19060-19063). Thus, a combined movement of the chemically interacting system in compliance with applied field results in oriented nanostructures. The thickness of these fibrous heterostructures in the composite form varied from 0.15 μm, 0.5 μm to 5 μm for 1:2, 1:10 and 1:30 WFF/WCNT ratios. A notable increase in thickness is observed as the content of FCNTs increase in the fluid. The role of interparticle magnetic interactions between nanoparticles attached to the side walls of CNT, can be easily discarded as another way of thickening. Since such an arrangement have been reported with instability imparted by anisotropic dipolar interactions among particles in chain-like structures (Journal of Physics: Condensed Matter, 2003, v. 15, no. 15, p. S1451; The Journal of Physical Chemistry B, 2005b, v. 109, no. 41, p. 19060-19063). So the thickening can be attributed to the dominating intertube interactions resulting by the consequent weakening of interactions between nanotubes and nanoparticles. This kind of intertube interactions are similar to the ones present in dried WCNT dispersion (images c-h). Moreover, a controlled slow evaporation favors the orderly formation of $Fe_3O_4$/FCNTs heterostructure in all the samples.

Figure 5:
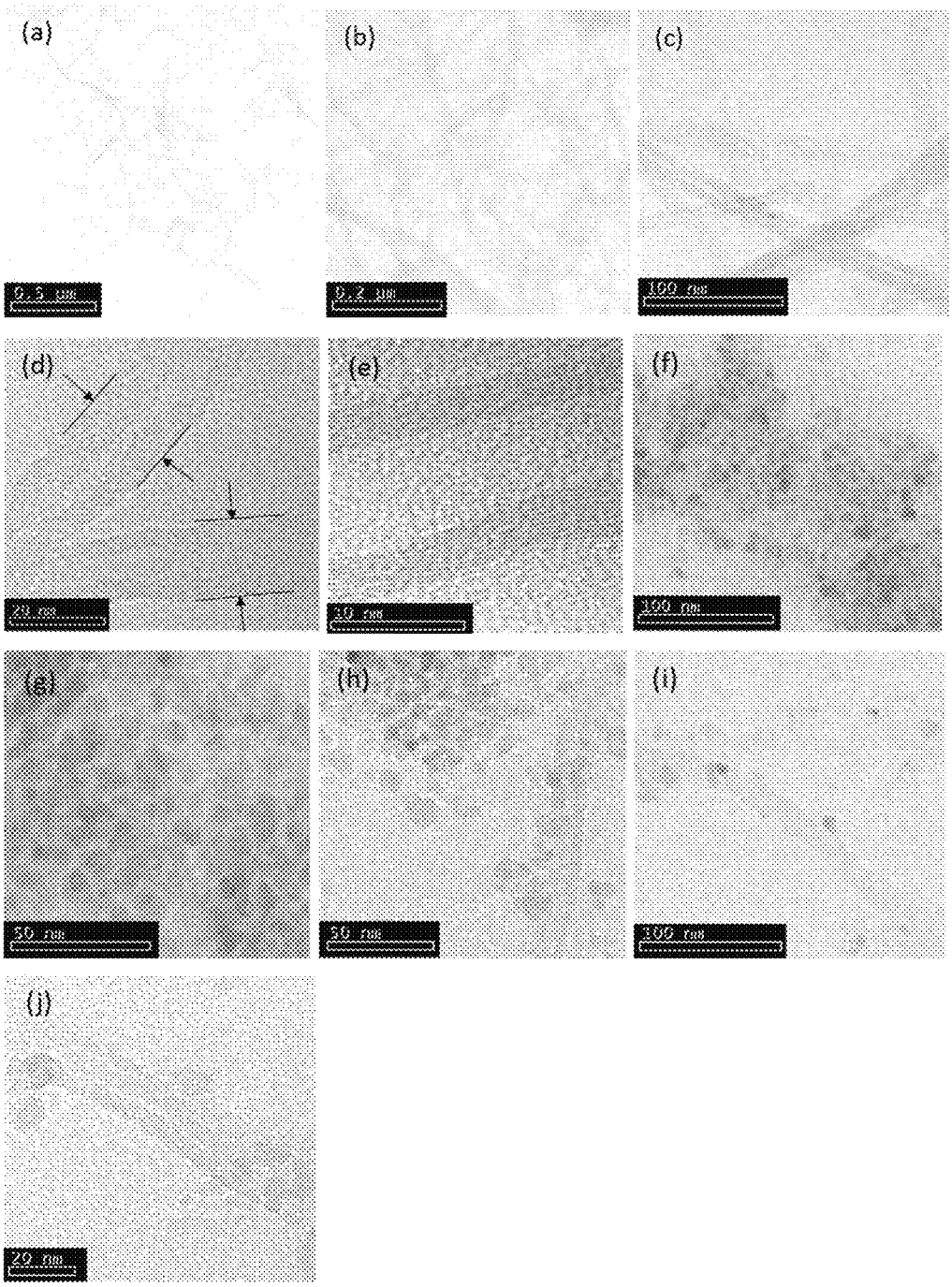
FIG. 5 TEM images of (a-e) FCNTs at different magnifications, (f-g) $Fe_3O_4$ nanoparticles and (h-j) $Fe_3O_4$/MWCNTs nanocomposites obtained after drying hybrid fluid.

After second stage of acid treatment as mentioned in section 6.2, the as obtained WCNT dispersion were dried on Cu-TEM grid to record TEM micrographs. FIGS. 5 (*a*) and (*b*) shows FCNTs morphological features which shows that they entangled with each other. The diameter and length of nanotubes were found to be in the range 14-18 nm and 1.7-2.5 μm respectively. From FIGS. 5 (*c*) and (*d*), one can conclude that WCNT dispersion is free from any carbonaceous impurities like amorphous carbon, carbon nanoparticles etc., which if present, can be inherent from supplier's end. FIG. 5 (*e*) shows a high resolution image of FCNT. The number of graphitic walls were found to be 9 nm. The diameter and which is in good agreement with the XRD results (table 1.). So, if one subtracts average coherence length, $L_c$ (3.1 nm) from outer diameter, then one can ascertain 10.9-14.9 nm as inner diameter. A close look on outer walls shows few regions with uneven and broken outer surface layer. Such destruction on side walls has been well reported as a consequence of prolonged acid treatment carried out for achieving functionalization (Carbon, 2008, v. 46, no. 6, p. 833-840; Carbon, 2008, v. 46, no. 15, p. 2003-2025; Carbon, 2009, v. 47, no. 13, p. 2970-2975). But the average coherence length determined from XRD remains unchanged after various treatments. This indicates that the extent of diffraction from graphite layers remains globally unchanged as destruction could have occurred to a limited extent, which is visible in FIG. 5 (*e*). FIGS. 5 (*f*) & (*g*) show Fe3O4 nanoparticles with size distribution 4-12 nm.

The TEM images of dried MWCNT-$Fe_3O_4$ hybrid fluid is shown in FIG. 5 (*h-j*). A large number of free particles were present on the TEM grid. Furthermore, none of the particles were found inside CNTs, even though a well match of inner diameter (10.9-14.9 nm) and particle size (3-10 nm) existed. Thus one can discard any kind of predominating capillary forces unlike reported elsewhere (Nano Letters, 2005, v. 5, no. 5, p. 879-884; Nanotechnology, 2009, v. 20, no. 5, p. 055607). In spite of all this, a very few percentage of particles were adsorbed onto the side walls from outside. Their interactions with the nanotubes play key role in deciding stability of nanocomposite in liquid state. The particle size distribution of $Fe_3O_4$ nanoparticles in WFF and adsorbed $Fe_3O_4$ nanoparticles were calculated and found nearly same. It has led to the conclusion that functionalized does not surface show any greater affinity for any selected size of particles and adsorption process is size independent.

Figure 6:
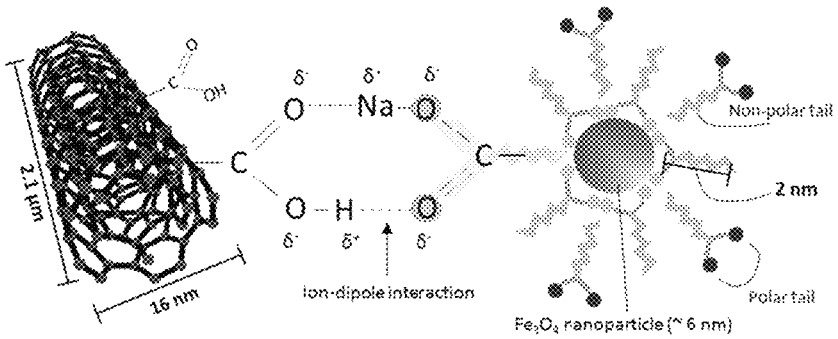
FIG. 6 Schematic illustration of weak ion-dipole interaction existing in $Fe_3O_4$/MWCNT hybrid fluid.

FIG. 6 represents the schematic illustration of $Fe_3O_4$/MWCNT nanocomposite in the hybrid fluid. The carboxylic groups of oleic acid (primary surfactant) and the carboxylic groups of sodium oleate (secondary surfactant) are shown. Both type of surfactants are held together by weak Van der Waals forces existing between their hydrophobic tails. There are three advantages of using double surfacted nanoparticles in preparing hybrid fluids which can be described as follows:

A greater extent of surface stabilization ensures minimal possibility of particle aggregation in WFF.

NPs have good dispersability in water which is same medium as that of WCNT dispersion.

Outer surface groups interact weakly via ion-dipole interaction with functional groups of FCNTs. Since only a fraction of particles are attached to FCNTs, the density of nanotubes is increased only slightly and fluid shows good magnetic stability.

ADVANTAGES OF THE INVENTION

1. There is no initial reaction between nanoparticles and nanotubes.
2. Both constituents have similar functional groups on outer surface and interact with each other via weak ion-dipole interactions.
3. The final step involves only physical mixing of the two dispersions.
4. The hybrid fluid remains stable for 6 months.
5. Both the dispersions were synthesized in aqueous medium and does not involve any organic solvent.
6. The whole process is simple, low cost and eco-friendly and does not involve any highly toxic substance and pollutants.
7. The synthesized hybrid fluid has excellent sedimentation and magnetic stability.

We claim:

1. A $Fe_3O_4$-MWCNT hybrid nanocomposite in liquid state comprising water based ferrofluid in fixed volume concentration and MWCNT, wherein the water based ferrofluid ranges between 1 to 30 in volume to 1 volume of MWCNT.

2. A process for the preparation of $Fe_3O_4$-MWCNT hybrid nanofluid comprising the steps of:

i. mixing ferrous sulphate heptahydrate and ferric chloride in the ratio 1:2 with a mixture of 25% (v/v) ammonia and in presence of primary surfactant and emulsifier followed by heating at temperature in the range of 30 to 60° C., magnetic decantating and washing to obtain a mixture;

ii. adding secondary surfactant dissolved in water at temperature in the range of 30 to 50° C. in the mixture as obtained in step (i) followed by centrifuging to obtain $Fe_3O_4$ dispersion;

iii. treating MWCNTs with $HNO_3$ and heating at temperature in the range of 25 to 30° C. for period in the range of 150 to 180 min followed by filtering and washing to obtain dried MWCNTs;

iv. treating dried MWCNTs as obtained in step (iii) with $HNO_3$ followed by sonicating; heating at temperature in the range of 80 to 90° C. for a period in the range of 55 to 65 hours, cooling filtering and washing to obtain filtered product;

v. dispersing the filtered product as obtained in step (iv) in water to obtain MWCNT dispersion;

vi. mixing dispersions as obtained in step (ii) and (v) in the volume ratio of the dispersion obtained in step (ii) to the dispersion obtained in step (v) ranges between 1 to 30 using mechanical stirring to obtain $Fe_3O_4$-MWCNT hybrid nanofluid.

3. The process as claimed in claim 2, wherein emulsifier used is acetone.

4. The process as claimed in claim 2, wherein primary surfactant used is oleic acid.

5. The process as claimed in claim 2, wherein secondary surfactant used is sodium oleate.

6. The process as claimed in claim 2, wherein ion-dipole interaction between $Fe_3O_4$-MWCNTs leads to stable suspension.

* * * * *